US010093998B2

(12) United States Patent
Nagao et al.

(10) Patent No.: US 10,093,998 B2
(45) Date of Patent: Oct. 9, 2018

(54) ABRASION RESISTANT STEEL PLATE HAVING EXCELLENT LOW-TEMPERATURE TOUGHNESS AND METHOD FOR MANUFACTURING THE SAME

(71) Applicant: JFE STEEL CORPORATION, Tokyo (JP)

(72) Inventors: Akihide Nagao, Kawasaki (JP); Shinichi Miura, Kurashiki (JP); Nobuyuki Ishikawa, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 488 days.

(21) Appl. No.: 14/779,576

(22) PCT Filed: Mar. 19, 2014

(86) PCT No.: PCT/JP2014/001596

§ 371 (c)(1),
(2) Date: Sep. 24, 2015

(87) PCT Pub. No.: WO2014/156079

PCT Pub. Date: Oct. 2, 2014

(65) Prior Publication Data

US 2016/0076118 A1 Mar. 17, 2016

(30) Foreign Application Priority Data

Mar. 28, 2013 (JP) ..... 2013-069931

(51) Int. Cl.

| | |
|---|---|
| ***C21D 9/46*** | (2006.01) |
| ***C22C 38/00*** | (2006.01) |
| ***C22C 38/32*** | (2006.01) |
| ***C22C 38/54*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/40*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***B22D 7/00*** | (2006.01) |
| ***C21D 6/00*** | (2006.01) |
| ***C22C 38/42*** | (2006.01) |

(52) U.S. Cl.

CPC ..... *C21D 9/46* (2013.01); *B22D 7/00* (2013.01); *C21D 6/004* (2013.01); *C21D 6/005* (2013.01); *C21D 6/008* (2013.01); *C21D 8/021* (2013.01); *C21D 8/0205* (2013.01); *C21D 8/0226* (2013.01); *C21D 8/0263* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/40* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/008* (2013.01)

(58) Field of Classification Search

CPC ..... C21D 9/46; C21D 6/004; C21D 6/005; C21D 6/008; C21D 8/0205; C21D 8/0226; C21D 8/0263; C21D 8/021; C22C 38/54; C22C 38/50; C22C 38/48; C22C 38/46; C22C 38/44; C22C 38/42; C22C 38/32; C22C 38/28; C22C 38/26; C22C 38/24; C22C 38/22; C22C 38/06; C22C 38/04; C22C 38/02; C22C 38/005; C22C 38/002; C22C 38/001

See application file for complete search history.

(56) References Cited

FOREIGN PATENT DOCUMENTS

| | | | |
|---|---|---|---|
| AU | 2009/355404 | A1 | 5/2012 |
| CN | 1626695 | A | 6/2005 |

(Continued)

OTHER PUBLICATIONS

Jan. 19, 2017 Office Action issued in Korean Patent Application No. 10-2015-7024679.

Feb. 22, 2018 Office Action issued in European Patent Application No. 14775751.2.

May 3, 2016 Office Action issued in Chinese Patent Application No. 201480018756.7.

Jun. 28, 2016 Office Action issued in Korean Patent Application No. 2015-7024679.

(Continued)

*Primary Examiner* — Jessee R Roe

(74) *Attorney, Agent, or Firm* — Oliff PLC

(57) ABSTRACT

Abrasion resistant steel plates with excellent low-temperature toughness having a Brinell hardness of 361 or more, and methods for manufacturing such steel plates. The steel plates have a lath martensitic structure with an average grain size of not more than 20 μm, and the steel plates include fine precipitates that are 50 nm or less in diameter and that have a density of 50 or more particles per 100 $\mu m^2$. Additionally, the steel plates include, by mass %, C: 0.10 to less than 0.20%, Si: 0.05 to 0.5%, Mn: 0.5 to 1.5%, Cr: 0.05 to 1.20%, Nb: 0.01 to 0.08%, B: 0.0005 to 0.003%, Al: 0.01 to 0.08%, N: 0.0005 to 0.008%, P: not more than 0.05%, S: not more than 0.005%, and O: not more than 0.008%, the balance being Fe and inevitable impurities.

22 Claims, No Drawings

(56) References Cited

FOREIGN PATENT DOCUMENTS

| | | | |
|---|---|---|---|
| CN | 102181794 | A | 9/2011 |
| CN | 102666897 | A | 9/2012 |
| CN | 102747282 | A | 10/2012 |
| CN | 102959112 | A | 3/2013 |
| EP | 1764423 | A1 | 3/2007 |
| EP | 2 589 675 | A1 | 5/2013 |
| EP | 2881485 | A1 | 6/2015 |
| JP | 2005-256169 | A | 9/2005 |
| JP | 2011052320 | A | 3/2011 |
| JP | 2011052321 | A | 3/2011 |
| JP | 2012-041638 | A | 3/2012 |
| KR | 10-2012-0070603 | A | 6/2012 |
| WO | 2011/061812 | A1 | 5/2011 |

OTHER PUBLICATIONS

Apr. 3, 2017 Office Action issued in European Patent Application No. 14775751.2.

Jan. 16, 2017 Office Action issued in Chinese Patent Application No. 201480018756.7.

Mar. 29, 2016 Extended European Search Report issued in European Application No. 14775751.2.

Apr. 9, 2018 Office Action issued in U.S. Appl. No. 14/779,627.

Jun. 27, 2018 Office Action issued in Chinese Patent Application No. 2017103620989.

ABRASION RESISTANT STEEL PLATE HAVING EXCELLENT LOW-TEMPERATURE TOUGHNESS AND METHOD FOR MANUFACTURING THE SAME

TECHNICAL FIELD

This application is directed to abrasion resistant steel plates having excellent low-temperature toughness and to methods for manufacturing such steel plates. In particular, the application is directed to techniques suited for abrasion resistant steel plates with excellent low-temperature toughness having a Brinell hardness of 361 or more.

BACKGROUND

In recent years, there is a trend for increasing the hardness of steel plates that are used in the field of industrial machinery in abrasive environments such as mines, civil engineering, agricultural machines and construction in order to, for example, extend the life of grinding ability to grind ores into powders.

However, increasing the hardness of steel is generally accompanied by a decrease in low-temperature toughness and consequently causes a risk that the steel may be cracked during use. Thus, there has been a strong demand for the enhancement in the low-temperature toughness of high-hardness abrasion resistant steel plates, in particular, abrasion resistant steel plates having a Brinell hardness of 361 or more.

Approaches to realizing abrasion resistant steel plates with excellent low-temperature toughness and methods for manufacturing such steel plates have been proposed in the art such as in Patent Literatures 1, 2 and 3 in which low-temperature toughness is improved by optimizing the carbon equivalent and the hardenability index.

CITATION LIST

Patent Literature

PTL 1: Japanese Unexamined Patent Application Publication No. 2002-256382

PTL 2: Japanese Patent No. 3698082

PTL 3: Japanese Patent No. 4238832

SUMMARY

Technical Problem

The Charpy absorbed energy at −40° C. that is stably obtained by the conventional methods, such as those described in Patent Literatures 1, 2 and 3, reaches a limit at about 50 to 100 J. Thus, there have been demands for abrasion resistant steel plates having higher low-temperature toughness and for methods capable of manufacturing such steel plates.

The disclosed embodiments thus provide abrasion resistant steel plates that have a Brinell hardness of 361 or more and still exhibit superior low-temperature toughness to the conventional abrasion resistant steel plates, and provide methods for manufacturing such steel plates.

Solution to Problem

Three basic quality design guidelines to enhance the low-temperature toughness of as-quenched lath martensitic steel are to reduce the size of high-angle grain boundaries which usually determine the fracture facet sizes, to decrease the amount of impurities such as phosphorus and sulfur which reduce the bond strength at grain boundaries, and to reduce the size and amount of inclusions which induce low-temperature brittleness.

The present inventors have carried out extensive studies directed to enhancing the low-temperature toughness of abrasion resistant steel plates based on the above standpoint. As a result, the present inventors have found that the coarsening of reheated austenite grains is suppressed by dispersing a large amount of fine precipitates such as Nb carbonitride having a diameter of not more than 50 nm and consequently the size of packets which determine the fracture facet sizes is significantly reduced to make it possible to obtain abrasion resistant steel plates having higher low-temperature toughness than the conventional materials.

The disclosed embodiments have been completed by further studies based on the above finding, and provide the following abrasion resistant steel plates having excellent low-temperature toughness and methods for manufacturing such steel plates.

(1) An abrasion resistant steel plate with excellent low-temperature toughness including, by mass %, C: 0.10% to less than 0.20%, Si: 0.05 to 0.5%, Mn: 0.5 to 1.5%, Cr: 0.05 to 1.20%, Nb: 0.01 to 0.08%, B: 0.0005 to 0.003%, Al: 0.01 to 0.08%, N: 0.0005 to 0.008%, P: not more than 0.05%, S: not more than 0.005% and O: not more than 0.008%, the balance being Fe and inevitable impurities, the steel plate including fine precipitates 50 nm or less in diameter with a density of 50 or more particles per 100 $\mu m^2$, the steel plate having a lath martensitic structure from the surface of the steel plate to at least a depth of ¼ of the plate thickness, the lath martensitic structure having an average grain size of not more than 20 μm wherein the average grain size is the average grain size of crystal grains surrounded by high-angle grain boundaries having an orientation difference of 15° or more, the steel plate having a Brinell hardness (HBW10/3000) of 361 or more.

(2) The abrasion resistant steel plate with excellent low-temperature toughness described in (1), wherein the steel further includes, by mass %, one, or two or more of Mo: not more than 0.8%, V: not more than 0.2% and Ti: not more than 0.05%.

(3) The abrasion resistant steel plate with excellent low-temperature toughness described in (1) or (2), wherein the chemical composition of the steel further includes, by mass %, one, or two or more of Nd: not more than 1%, Cu: not more than 1%, Ni: not more than 1%, W: not more than 1%, Ca: not more than 0.005%, Mg: not more than 0.005% and REM: not more than 0.02% (note: REM is an abbreviation for rare earth metal).

(4) The abrasion resistant steel plate with excellent low-temperature toughness described in any one of (1) to (3), wherein the contents of Nb, Ti, Al and V satisfy $0.03 \leq Nb+Ti+Al+V \leq 0.14$ wherein Nb, Ti, Al and V indicate the respective contents (mass %) and are 0 when Nb, Ti, Al and V are not added.

(5) The abrasion resistant steel plate with excellent low-temperature toughness described in any one of (1) to (4), wherein the plate thickness is 6 to 125 mm.

(6) The abrasion resistant steel plate described in any one of (1) to (5), wherein the Charpy absorbed energy at −40° C. is not less than 27 J.

(7) A method for manufacturing an abrasion resistant steel plate with excellent low-temperature toughness, including casting a steel having the chemical composition described in any one of (1) to (4), hot rolling the slab into a steel plate having a prescribed plate thickness, reheating the steel plate to $Ac_3$ transformation point or above, and subsequently quenching the steel plate by water cooling from a temperature of not less than $Ar_3$ transformation point to a temperature of not more than 250° C.

(8) The method for manufacturing an abrasion resistant steel plate with excellent low-temperature toughness described in (7), further including reheating the cast slab to 1100° C. or above.

(9) The method for manufacturing an abrasion resistant steel plate with excellent low-temperature toughness described in (7) or (8), wherein the rolling reduction during the hot rolling in an unrecrystallized region is not less than 30%.

(10) The method for manufacturing an abrasion resistant steel plate with excellent low-temperature toughness described in any one of (7) to (9), further including cooling the hot-rolled steel plate by water cooling to a temperature of not more than 250° C.

(11) The method for manufacturing an abrasion resistant steel plate with excellent low-temperature toughness described in any one of (7) to (10), wherein the reheating of the hot-rolled or water-cooled steel plate to $Ac_3$ transformation point or above is performed at a rate of not less than 1° C./s.

Advantageous Effects

The abrasion resistant steel plates of the disclosed embodiments have a Brinell hardness of 361 or more and still exhibit superior low-temperature toughness. Additionally, the disclosed embodiments include methods of manufacturing such steel plates. These advantages are very useful in industry.

DETAILED DESCRIPTION

An abrasion resistant steel plate of the disclosed embodiments includes a lath martensitic steel having a microstructure in which the region from the surface of the steel plate to at least a depth of ¼ of the plate thickness is a lath martensitic structure and the average grain size of crystal grains surrounded by high-angle grain boundaries having an orientation difference of 15° or more is not more than 20 μm, preferably not more than 10 μm, and more preferably not more than 5 μm.

High-angle grains serve as locations where slips are accumulated. The reduction of the size of high-angle grains remedies the concentration of stress due to the accumulation of slips to the grain boundaries, and hence reduces the occurrence of cracks due to brittle fracture, thereby enhancing low-temperature toughness. The effect in enhancing low-temperature toughness is increased with decreasing grain sizes. The marked effect may be obtained by controlling the average grain size of crystal grains surrounded by high-angle grain boundaries having an orientation difference of 15° or more to not more than 20 μm. The average grain size is preferably not more than 10 μm, and more preferably not more than 5 μm.

For example, the crystal orientations may be measured by analyzing the crystal orientations in a 100 μm square region by an EBSP (electron back scattering pattern) method. Assuming that the high angle refers to 15° or more difference in the orientations of grain boundaries, the diameters of grains surrounded by such grain boundaries are measured and the simple average of the results is determined.

In the disclosed embodiments, the steel includes fine precipitates having a diameter of not more than 50 nm, preferably not more than 20 nm, and more preferably not more than 10 nm with a density of 50 or more particles per 100 $\mu m^2$.

The main fine precipitates for which the effects have been confirmed are Nb carbonitrides, Ti carbonitrides, Al nitrides and V carbides. However, the precipitates are not limited thereto as long as the sizes are met, and may include other forms such as oxides. The fine precipitates having a smaller diameter and a larger density provide higher effects in suppressing the coarsening of crystals by virtue of their pinning effect. The size of crystal grains is reduced and low-temperature toughness is enhanced by the presence of at least 50 or more particles of fine precipitates having a diameter of not more than 50 nm, preferably not more than 20 nm, and more preferably not more than 10 nm per 100 $\mu m^2$.

To determine the average particle diameter of the fine precipitates, for example, a specimen prepared by a carbon extraction replica method is observed and photographed by TEM, and the image is analyzed to measure the average particle diameter of 50 or more particles of fine precipitates as the simple average.

The Brinell hardness is 361 or more in order to obtain high abrasion resistant performance. The plate thickness is 6 to 125 mm that is the general range of the thickness of abrasion resistant steel plates. However, the plate thickness is not limited to this range and the techniques of the disclosed embodiments are applicable to steel plates having other thicknesses. It is not always necessary that the steel plate is composed of the lath martensitic structure throughout its entirety. Depending on use, for example, the lath martensitic structure may extend from the surface of the steel plate to a depth of ¼ of the plate thickness, and the other region extending from ¼ to ¾ of the plate thickness may be, for example, lower bainitic structure or upper bainitic structure.

A preferred chemical composition and conditions for the manufacturing of the abrasion resistant steel plates having the aforementioned microstructure are limited for the reasons described below.

[Chemical composition] The unit % in the chemical composition is mass %.

C: 0.10% to less than 0.20%

Carbon is added to ensure martensite hardness and hardenability. These effects are not obtained sufficiently if the amount added is less than 0.10%. On the other hand, adding 0.20% or more carbon results in a decrease in the toughness of base steel and weld heat affected zones, and also causes a marked decrease in weldability. Thus, the C content is limited to 0.10% to less than 0.20%.

Si: 0.05 to 0.5%

Silicon is added as a deoxidizer in steelmaking and also as an element for ensuring hardenability. These effects are not obtained sufficiently if the amount added is less than 0.05%. If, on the other hand, more than 0.5% silicon is added, grain boundaries are embrittled and low-temperature toughness is decreased. Thus, the Si content is limited to 0.05 to 0.5%.

Mn: 0.5 to 1.5%

Manganese is added as an element for ensuring hardenability. This effect is not obtained sufficiently if the amount added is less than 0.5%. If, on the other hand, more than 1.5% manganese is added, the strength at grain boundaries is lowered and low-temperature toughness is decreased. Thus, the Mn content is limited to 0.5 to 1.5%.

Cr: 0.05 to 1.20%

Chromium is added as an element for ensuring hardenability. This effect is not obtained sufficiently if the amount added is less than 0.05%. On the other hand, adding more than 1.20% chromium results in a decrease in weldability. Thus, the Cr content is limited to 0.05 to 1.20%.

Nb: 0.01 to 0.08%

Niobium forms Nb carbonitrides in the form of fine precipitates which serve to pin heated austenite grains and thus suppress the coarsening of grains. This effect is not obtained sufficiently if the Nb content is less than 0.01%. On the other hand, adding more than 0.08% niobium causes a decrease in the toughness of weld heat affected zones. Thus, the Nb content is limited to 0.01 to 0.08%.

B: 0.0005 to 0.003%

Boron is added as an element for ensuring hardenability. This effect is not obtained sufficiently if the amount added is less than 0.0005%. Adding more than 0.003% boron causes a decrease in toughness. Thus, the B content is limited to 0.0005 to 0.003%.

Al: 0.01 to 0.08%

Aluminum is added as a deoxidizer and also forms Al nitrides in the form of fine precipitates which serve to pin heated austenite grains and thus suppress the coarsening of grains. Further, aluminum fixes free nitrogen as Al nitrides and thereby suppresses the formation of B nitrides to allow free boron to be effectively used for the enhancement of hardenability. Thus, in the disclosed embodiments, it is most important to control the Al content. Aluminum needs to be added in 0.01% or more because the above effects are not obtained sufficiently if the Al content is less than 0.01%. Preferably, it is recommended to add 0.02% or more aluminum, and more preferably 0.03% or more aluminum. On the other hand, adding more than 0.08% aluminum increases the probability of the occurrence of surface defects on the steel plates. Thus, the Al content is limited to 0.01 to 0.08%.

N: 0.0005 to 0.008%

Nitrogen forms nitrides with elements such as niobium, titanium and aluminum in the form of fine precipitates which serve to pin heated austenite grains and thereby suppress the coarsening of grains. Thus, nitrogen is added to obtain an effect in enhancing low-temperature toughness. The effect in reducing the size of microstructure is not obtained sufficiently if the amount added is less than 0.0005%. If, on the other hand, more than 0.008% nitrogen is added, the amount of solute nitrogen is so increased that the toughness of base steel and weld heat affected zones is decreased. Thus, the N content is limited to 0.0005 to 0.008%.

P: not more than 0.05%

Phosphorus is an impurity element and is readily segregated in crystal grain boundaries. If the P content exceeds 0.05%, the strength of bonding between adjacent crystal grains is lowered and low-temperature toughness is decreased. Thus, the P content is limited to not more than 0.05%.

S: not more than 0.005%

Sulfur is an impurity element and is readily segregated in crystal grain boundaries. Sulfur also tends to form MnS which is a nonmetal inclusion. Adding more than 0.005% sulfur decreases the strength of bonding between adjacent crystal grains, and also increases the amount of inclusions, resulting in a decrease in low-temperature toughness. Thus, the S content is limited to not more than 0.005%.

O: not more than 0.008%

Oxygen affects the workability of steel through the formation of oxides with elements such as aluminum. If more than 0.008% oxygen is added, workability is deteriorated due to the increase in the amount of inclusions. Thus, the 0 content is limited to not more than 0.008%.

The abrasion resistant steel plate of the disclosed embodiments is composed of the basic components described above and the balance that is Fe and inevitable impurities.

In the disclosed embodiments, the following components may be further added in accordance with desired characteristics.

Mo: not more than 0.8%

Molybdenum has an effect of enhancing hardenability. However, this effect is not obtained sufficiently if the amount added is less than 0.05%. It is therefore preferable to add 0.05% or more molybdenum. Economic efficiency is deteriorated if more than 0.8% molybdenum is added. Thus, the content of molybdenum, when added, is limited to not more than 0.8%.

V: not more than 0.2%

Vanadium has an effect of enhancing hardenability and also forms V carbides in the form of fine precipitates which serve to pin heated austenite grains and thereby suppress the coarsening of grains. These effects are not obtained sufficiently if the amount added is less than 0.005%. It is therefore preferable to add 0.005% or more vanadium. However, adding more than 0.2% vanadium results in a decrease in the toughness of weld heat affected zones. Thus, the content of vanadium, when added, is limited to not more than 0.2%.

Ti: not more than 0.05%

Titanium forms Ti carbonitrides in the form of fine precipitates which serve to pin heated austenite grains and thus suppress the growth of grains. Further, titanium fixes free nitrogen as Ti nitrides and thereby suppresses the formation of B nitrides to allow free boron to be effectively used for the enhancement of hardenability. However, these effects are not obtained sufficiently if the amount added is less than 0.005%. It is therefore preferable to add 0.005% or more titanium. However, adding more than 0.05% titanium results in a decrease in the toughness of weld heat affected zones. Thus, the content of titanium, when added, is limited to not more than 0.05%.

Nd: not more than 1%

Neodymium decreases the amount of sulfur segregated at grain boundaries by incorporating sulfur as inclusions, and thereby enhances low-temperature toughness. However, these effects are not obtained sufficiently if the amount added is less than 0.005%. It is therefore preferable to add 0.005% or more neodymium. However, adding more than 1% neodymium results in a decrease in the toughness of weld heat affected zones. Thus, the content of neodymium, when added, is limited to not more than 1%.

Cu: not more than 1%

Copper has an effect of enhancing hardenability. However, this effect is not obtained sufficiently if the amount added is less than 0.05%. It is therefore preferable to add 0.05% or more copper. If, however, the Cu content exceeds 1%, hot tearing tends to occur during slab heating and welding. Thus, the content of copper, when added, is limited to not more than 1%.

Ni: not more than 1%

Nickel has an effect of enhancing toughness and hardenability. However, this effect is not obtained sufficiently if the amount added is less than 0.05%. It is therefore preferable to add 0.05% or more nickel. If, however, the Ni content exceeds 1%, economic efficiency is decreased. Thus, the content of nickel, when added, is limited to not more than 1%.

W: not more than 1%

Tungsten has an effect of enhancing hardenability. This effect is not obtained sufficiently if the amount added is less than 0.05%. It is therefore preferable to add 0.05% or more tungsten. However, adding more than 1% tungsten causes a decrease in weldability. Thus, the content of tungsten, when added, is limited to not more than 1%.

Ca: not more than 0.005%

Calcium has an effect of controlling the form of sulfide inclusion to CaS that is a spherical inclusion hardly extended by rolling, instead of MnS that is a form of inclusion readily extended by rolling. However, this effect is not obtained sufficiently if the amount added is less than 0.0005%. It is therefore preferable to add 0.0005% or more calcium. However, adding more than 0.005% calcium decreases cleanliness and results in a deterioration in quality such as toughness. Thus, the content of calcium, when added, is limited to not more than 0.005%.

Mg: not more than 0.005%

Magnesium is sometimes added as a desulfurizer for hot metal. However, this effect is not obtained sufficiently if the amount added is less than 0.0005%. It is therefore preferable to add 0.0005% or more magnesium. However, adding more than 0.005% magnesium causes a decrease in cleanliness. Thus, the amount of magnesium, when added, is limited to not more than 0.005%.

REM: not more than 0.02%

Rare earth metals form oxysulfides REM(O, S) in steel and thereby decrease the amount of solute sulfur at crystal grain boundaries to provide improved SR cracking resistance characteristics. However, this effect is not obtained sufficiently if the amount added is less than 0.0005%. It is therefore preferable to add 0.0005% or more rare earth metals. However, adding more than 0.02% rare earth metals results in excessive buildup of REM sulfides in sedimentation zones and causes a decrease in quality. Thus, the amount of rare earth metals, when added, is limited to not more than 0.02%.

$$0.03 \leq Nb+Ti+Al+V \leq 0.14$$

Niobium, titanium, aluminum and vanadium form Nb carbonitrides, Ti carbonitrides, Al nitrides and V carbides in the form of fine precipitates which serve to pin heated austenite grains and thus suppress the coarsening of grains. Detailed studies of the relationship between the contents of these elements and the grain size have shown that a marked reduction in crystal grain size is achieved and an enhancement in low-temperature toughness is obtained when the contents satisfy $0.03 \leq Nb+Ti+Al+V \leq 0.14$. Thus, the contents are limited to $0.03 \leq Nb+Ti+Al+V \leq 0.14$. Here, Nb, Ti, Al and V indicate the respective contents (mass %) and are 0 when these elements are absent.

[Manufacturing Conditions]

The shapes of the abrasion resistant steel plates of the disclosed embodiments are not limited to steel plates and may be any of other various shapes such as pipes, shaped steels and rod steels. The temperature and the heating rate specified in the manufacturing conditions are parameters describing the central area of the steel, namely, the center through the plate thickness of a steel plate, the center through the plate thickness of a portion of a shaped steel to which the characteristics of the disclosed embodiments are imparted, or the center of the radial directions of a rod steel. However, regions in the vicinity of the central area undergo substantially the same temperature history and thus the above parameters do not strictly describe the temperature conditions for the exact center.

Casting Conditions

The disclosed embodiments are effective for steels manufactured under any casting conditions. It is therefore not necessary to set particular limitations on the casting conditions. That is, casting of molten steel and rolling of cast steel into slabs may be performed by any methods without limitation. Use may be made of steels smelted by a process such as a converter steelmaking process or an electric steelmaking process, and slabs produced by a process such as continuous casting or ingot casting. Reheating and quench hardening The steel plate that has been hot rolled to a prescribed plate thickness is reheated to $Ac_3$ transformation point or above, and is subsequently quenched by water cooling from a temperature of not less than $Ar_3$ transformation point to a temperature of not more than 250° C., thereby forming a lath martensitic structure.

If the reheating temperature is below $Ac_3$ transformation point, part of the ferrite remains untransformed and consequently subsequent water cooling fails to achieve the target hardness. If the temperature falls below $Ar_3$ transformation point before water cooling, part of the austenite is transformed before water cooling and consequently subsequent water cooling fails to achieve the target hardness. If water cooling is terminated at a temperature higher than 250° C., the crystal may be partly transformed into structures other than lath martensite. Thus, the reheating temperature is limited to not less than $Ac_3$ transformation point, the water cooling start temperature is limited to not less than $Ar_3$ transformation point, and the water cooling finish temperature is limited to not more than 250° C.

In the disclosed embodiments, $Ac_3$ transformation point (° C.) and $Ar_3$ transformation point (° C.) may be obtained by using any equations without limitation. For example, $Ac_3=854-180C+44Si-14Mn-17.8Ni-1.7Cr$ and $Ar_3=910-310C-80Mn-20Cu-15Cr-55Ni-80Mo$. In the equations, the element symbols indicate the contents (mass %) in the steel.

In the disclosed embodiments, the following limitations on the manufacturing conditions may be further adopted in accordance with desired characteristics.

Hot Rolling Conditions

When appropriate, the slab is reheated to a temperature that is preferably controlled to not less than 1100° C., more preferably not less than 1150° C., and still more preferably not less than 1200° C. The purpose of this control is to allow a larger amount of crystals such as Nb crystals formed in the slab to be dissolved in the slab and thereby to effectively ensure a sufficient amount of fine precipitates that will be formed.

When hot rolling is controlled, it is preferable that the rolling reduction in an unrecrystallized region be not less than 30%, more preferably not less than 40%, and still more preferably not less than 50%. The purpose of rolling in an unrecrystallized region with 30% or more reduction is to form fine precipitates by the strain-induced precipitation of precipitates such as Nb carbonitrides.

Cooling

When water cooling is performed after the completion of hot rolling, it is preferable that the steel plate be forcibly cooled to a temperature of not more than 250° C. The purpose of this cooling is to restrain the growth of fine precipitates that have been formed by strain-induced precipitation during the rolling.

Temperature-Increasing Rate During Reheating

When the reheating temperature during reheating for quench hardening is controlled, it is preferable that the steel plate be reheated to $Ac_3$ transformation point or above at a rate of not less than 1° C./s. The purpose of this control is to restrain the growth of fine precipitates formed before the reheating and the growth of fine precipitates formed during the reheating. The heating method may be any of, for example, induction heating, electrical heating, infrared radiation heating and atmospheric heating as long as the desired temperature-increasing rate is achieved.

Under the aforementioned conditions, abrasion resistant steel plates having fine crystal grains and exhibiting excellent low-temperature toughness may be obtained.

EXAMPLES

Steels A to K having a chemical composition described in Table 1 were smelted and cast into slabs, which were worked under conditions described in Table 2 to form steel plates. The temperature of the plates was measured with a thermocouple inserted to the central area through the plate thickness.

Table 2 describes the structures of the steel plates, the average grain sizes of crystal grains surrounded by high-angle grain boundaries having an orientation difference of 15° or more, the densities of fine precipitates with a diameter of not more than 50 nm, and the Brinell hardnesses and the Charpy absorbed energies at −40° C. of the steel plates obtained.

To determine the structures in the steel plate, a sample was collected from a cross section perpendicular to the rolling direction, the cross section was specular polished and etched with a nitric acid methanol solution, and the structures were identified by observation with an optical microscope at ×400 magnification with respect to an area that was 0.5 mm below the steel plate surface and an area that corresponded to ¼ of the plate thickness.

To measure the crystal orientations, a 100 μm square region that included an area corresponding to ¼ of the plate thickness was analyzed by an EBSP (electron back scattering pattern) method. While defining a high angle as being a 15° or more difference in the orientations of grain boundaries, the diameters of grains surrounded by such grain boundaries were measured and the simple average of the results was obtained.

To determine the numerical density of fine precipitates per unit area, a specimen prepared from an area corresponding to ¼ of the plate thickness by a carbon extraction replica method was observed and photographed by TEM. The number of fine precipitates having a diameter of not more than 50 nm was counted, and the numerical density per 100 $\mu m^2$ was obtained.

To determine the Brinell hardness, an area that was 0.5 mm below the steel plate surface was tested in accordance with JIS 22243 (2008) with a testing force of 3000 kgf with use of a cemented carbide ball having an indenter diameter of 10 mm (HBW10/3000). The Charpy absorbed energy at −40° C. was measured in accordance with JIS 22242 (2005) with respect to full-size Charpy V-notch specimens that had been collected from an area at ¼ of the plate thickness along a direction perpendicular to the rolling direction. The data was obtained from three specimens representing the respective conditions, and the results were averaged.

The target values (the inventive range) of the Brinell hardness were 361 and above, and those of the Charpy absorbed energy at −40° C. were 27 J and above.

TABLE 1

(mass %)

| Steels | C | Si | Mn | Cr | Nb | B | Al | T.N | P | S | O | Mo |
|---|---|---|---|---|---|---|---|---|---|---|---|---|
| A | 0.14 | 0.32 | 0.97 | 0.38 | 0.019 | 0.0010 | 0.020 | 0.0035 | 0.012 | 0.0016 | 0.0032 | |
| B | 0.14 | 0.38 | 1.19 | 0.11 | 0.022 | 0.0012 | 0.027 | 0.0033 | 0.011 | 0.0017 | 0.0033 | 0.13 |
| C | 0.15 | 0.37 | 1.03 | 0.12 | 0.021 | 0.0009 | 0.033 | 0.0037 | 0.010 | 0.0015 | 0.0035 | 0.26 |
| D | 0.15 | 0.32 | 0.97 | 0.75 | 0.019 | 0.0013 | 0.026 | 0.0028 | 0.013 | 0.0021 | 0.0041 | 0.36 |
| E | 0.15 | 0.31 | 0.99 | 0.77 | 0.021 | 0.0015 | 0.051 | 0.0031 | 0.011 | 0.0016 | 0.0032 | 0.32 |
| F | 0.16 | 0.31 | 0.95 | 0.91 | 0.025 | 0.0009 | 0.033 | 0.0033 | 0.017 | 0.0019 | 0.0032 | 0.51 |
| G | 0.16 | 0.30 | 0.96 | 1.18 | 0.032 | 0.0011 | 0.032 | 0.0032 | 0.013 | 0.0009 | 0.0035 | 0.78 |
| H | 0.15 | 0.36 | 0.99 | 0.11 | 0.001 | 0.0012 | 0.020 | 0.0042 | 0.009 | 0.0016 | 0.0032 | 0.26 |
| I | 0.16 | 0.33 | 1.01 | 0.77 | 0.004 | 0.0014 | 0.023 | 0.0034 | 0.015 | 0.0018 | 0.0028 | 0.32 |
| J | 0.15 | 0.29 | 0.98 | 0.77 | 0.017 | 0.0012 | 0.009 | 0.0035 | 0.006 | 0.0017 | 0.0033 | 0.37 |
| K | 0.15 | 0.32 | 1.02 | 0.79 | 0.019 | 0.0014 | 0.006 | 0.0032 | 0.015 | 0.0011 | 0.0035 | 0.31 |

| Steels | V | Ti | Nd | Cu | Ni | W | Ca | Mg | REM | Nb + Ti + Al + V | $Ac_3$ (° C.) | $Ar_3$ (° C.) |
|---|---|---|---|---|---|---|---|---|---|---|---|---|
| A | | 0.014 | | | | | | | | 0.05 | 829 | 783 |
| B | | 0.012 | | | | | | | | 0.06 | 829 | 759 |
| C | | 0.015 | | | | | | | | 0.07 | 829 | 759 |
| D | 0.042 | 0.012 | | | | | | | | 0.10 | 826 | 746 |
| E | 0.041 | 0.001 | | | | | | | | 0.11 | 825 | 747 |
| F | 0.041 | 0.012 | | 0.29 | 0.28 | | | | | 0.11 | 819 | 709 |
| G | 0.043 | 0.011 | 0.023 | | | 0.23 | 0.0023 | 0.0024 | 0.0025 | 0.12 | 823 | 704 |
| H | | | | | | | | | | 0.02 | 829 | 762 |
| I | 0.039 | 0.014 | | | | | | | | 0.08 | 824 | 742 |
| J | 0.041 | 0.013 | | | | | | | | 0.08 | 825 | 744 |
| K | 0.039 | 0.002 | | | | | | | | 0.07 | 825 | 745 |

Note 1:

Ac3 (° C.) = 854 − 180C + 44Si − 14Mn − 17.8Ni − 1.7Cr wherein the element symbols indicate the contents (mass %).

Note 2:

Ar3 (° C.) = 910 − 310C − 80Mn − 20Cu − 15Cr − 55Ni − 80Mo wherein the element symbols indicate the contents (mass %).

Note 3:

Blanks indicate that the elements were not added and the contents were below the detection limits.

Note 4:

The underlined values are outside the inventive ranges.

TABLE 2

| No. | Steels | Plate thickness (mm) | Heating temp. (° C.) | Rolling reduction in unrecrystallized region (%) | Water cooling finish temp. (° C.) | Reheating rate (° C./s) | Reheating temp. (° C.) | Water cooling start temp. (° C.) | Water cooling finish temp. (° C.) |
|---|---|---|---|---|---|---|---|---|---|
| 1 | A | 12 | 1050 | 40 | — | 0.3 | 900 | 800 | 200 |
| 2 | B | 25 | 1100 | 0 | — | 0.3 | 900 | 820 | 200 |
| 3 | C | 32 | 1150 | 40 | — | 0.3 | 900 | 840 | 200 |
| 4 | D | 60 | 1150 | 60 | — | 0.3 | 900 | 850 | 200 |
| 5 | E | 60 | 1150 | 60 | — | 0.3 | 900 | 850 | 200 |
| 6 | F | 100 | 1200 | 30 | — | 0.3 | 870 | 840 | 200 |
| 7 | G | 125 | 1200 | 30 | — | 0.3 | 860 | 840 | 200 |
| 8 | H | 32 | 1150 | 30 | — | 0.3 | 900 | 840 | 200 |
| 9 | I | 32 | 1150 | 30 | — | 0.3 | 900 | 840 | 200 |
| 10 | A | 12 | 1150 | 40 | — | 0.3 | 900 | 800 | 200 |
| 11 | B | 25 | 1100 | 30 | — | 0.3 | 900 | 820 | 200 |
| 12 | C | 32 | 1150 | 40 | — | 0.3 | 820 | 760 | 200 |
| 13 | D | 60 | 1150 | 60 | — | 0.3 | 900 | 720 | 200 |
| 14 | E | 60 | 1200 | 60 | — | 0.3 | 900 | 850 | 200 |
| 15 | F | 100 | 1200 | 30 | 200 | 0.3 | 870 | 840 | 200 |
| 16 | G | 125 | 1200 | 30 | — | 2.0 | 860 | 840 | 200 |
| 17 | J | 60 | 1150 | 60 | — | 0.3 | 900 | 850 | 200 |
| 18 | K | 60 | 1150 | 60 | — | 0.3 | 900 | 850 | 200 |

| No. | Structures in steel plate (at 0.5 mm below the surface and at ¼ thickness) | Average grain size (μm) | Fine precipitate density (particles/100 μm$^2$) | Brinell hardness (HBW10/3000) | vE-40° C. (J) | Categories |
|---|---|---|---|---|---|---|
| 1 | LM | 15 | 62 | 402 | 167 | Inv. Ex. |
| 2 | LM | 16 | 75 | 405 | 123 | Inv. Ex. |
| 3 | LM | 14 | 91 | 421 | 98 | Inv. Ex. |
| 4 | LM | 12 | 123 | 397 | 75 | Inv. Ex. |
| 5 | LM | 11 | 135 | 407 | 77 | Inv. Ex. |
| 6 | LM | 16 | 132 | 412 | 56 | Inv. Ex. |
| 7 | LM | 15 | 156 | 423 | 42 | Inv. Ex. |
| 8 | LM | 65 | 19 | 421 | 12 | Comp. Ex. |
| 9 | LM | 42 | 27 | 401 | 17 | Comp. Ex. |
| 10 | LM | 9 | 93 | 397 | 192 | Inv. Ex. |
| 11 | LM | 11 | 102 | 395 | 153 | Inv. Ex. |
| 12 | LM + F | 9 | 74 | 323 | 125 | Comp. Ex. |
| 13 | LM + F | 10 | 119 | 301 | 102 | Comp. Ex. |
| 14 | LM | 6 | 179 | 402 | 112 | Inv. Ex. |
| 15 | LM | 14 | 151 | 401 | 73 | Inv. Ex. |
| 16 | LM | 12 | 161 | 415 | 61 | Inv. Ex. |
| 17 | LM | 32 | 42 | 411 | 19 | Comp. Ex. |
| 18 | LM | 45 | 35 | 421 | 17 | Comp. Ex. |

Note 1:
The underlined values or results are outside the inventive ranges.
Note 2:
Structures in steel plate LM: lath martensite, F: ferrite The steel plates Nos. 1 to 7, 10, 11 and 14 to 16 described in Table 2 satisfied the chemical composition and the manufacturing conditions required of the disclosed embodiments. These steel plates also satisfied the average grain size and the density of fine precipitates required of the disclosed embodiments and achieved the target values of Brinell hardness and vE-40° C.

The heating temperatures used for the steel plates Nos. 10 and 14 were increased as compared to those used for the steel plates Nos. 1 and 5, respectively, resulting in a finer grain size and a larger density of fine precipitates. Consequently, higher vE-40° C. was obtained.

The steel plate No. 11 involved a larger rolling reduction in an unrecrystallized region than the steel plate No. 2. Consequently, the grain size was reduced, the density of fine precipitates was increased, and vE-40° C. was enhanced.

The steel plate No. 15 involved water cooling after rolling in contrast to the steel plate No. 6. Consequently, the grain size was reduced, the density of fine precipitates was increased, and vE-40° C. was enhanced.

The steel plate No. 16 involved a higher temperature-increasing rate during reheating as compared to the steel plate No. 7. Consequently, the grain size was reduced, the density of fine precipitates was increased, and vE-40° C. was enhanced.

On the other hand, the Nb content and the (Nb+Ti+Al+V) content in the steel plate No. 8, and the Nb content in the steel plate No. 9 were below the lower limits of the disclosed embodiments. Consequently, their average grain sizes, densities of fine precipitates and vE-40° C. did not reach the target values.

In the steel plate No. 12, the region from the surface to a depth of ¼ of the plate thickness included a two-phase structure, namely ferrite and martensite, due to the reheating temperature being less than $Ac_3$. The failure of the sufficient formation of lath martensitic structure resulted in a Brinell hardness below the level required of the disclosed embodiments.

In the steel plate No. 13, the region from the surface to a depth of ¼ of the plate thickness included a two-phase structure, namely ferrite and martensite, due to the water cooling start temperature being less than $Ar_3$. The failure of the sufficient formation of lath martensitic structure resulted in a Brinell hardness below the level required of the disclosed embodiments.

On the other hand, the steel plates Nos. 17 and 18 had an Al content below the lower limit of the disclosed embodiments. Consequently, their average grain sizes, densities of fine precipitates and vE-40° C. did not reach the target values.

The invention claimed is:

1. An abrasion resistant steel plate comprising:

C: 0.10 to less than 0.20%, by mass %;

Si: 0.05 to 0.5%, by mass %;

Mn: 0.5 to 1.5%, by mass %;

Cr: 0.05 to 1.20%, by mass %;

Nb: 0.01 to 0.08%, by mass %;

B: 0.0005 to 0.003%, by mass %;

Al: 0.01 to 0.08%, by mass %;

N: 0.0005 to 0.008%, by mass %;

P: not more than 0.05%, by mass %;

S: not more than 0.005%, by mass %;

O: not more than 0.008%, by mass %; and remaining Fe and unavoidable inevitable impurities as a balance, wherein:

the steel plate includes fine precipitates that are 50 nm or less in diameter and that have a density of 50 or more particles per 100 $\mu m^2$, the steel plate has a lath martensitic structure from the surface of the steel plate to at least a depth of ¼ of the plate thickness, the lath martensitic structure having an average grain size of not more than 20 μm such that the average grain size is the average grain size of crystal grains surrounded by high-angle grain boundaries having an orientation difference of 15° or more, and the steel plate has a Brinell hardness (HBW10/3000) of 361 or more.

2. The abrasion resistant steel plate according to claim 1, wherein the steel plate further comprises at least one of Mo: not more than 0.8%, by mass %, V: not more than 0.2%, by mass %, and Ti: not more than 0.05%, by mass %.

3. The abrasion resistant steel plate according to claim 2, wherein the steel plate further comprises at least one of Nd: not more than 1%, by mass %, Cu: not more than 1%, by mass %, Ni: not more than 1%, by mass %, W: not more than 1%, by mass %, Ca: not more than 0.005%, by mass %, Mg: not more than 0.005%, by mass %, and rare earth metal: not more than 0.02%, by mass %.

4. The abrasion resistant steel plate according to claim 3, wherein the contents of Nb, Ti, Al and V satisfy $0.03 \leq Nb+Ti+Al+V \leq 0.14$ such that Nb, Ti, Al and V indicate the mass % contents of the respective elements and are 0 when Nb, Ti, Al and V are not added.

5. The abrasion resistant steel plate according to claim 2, wherein the contents of Nb, Ti, Al and V satisfy $0.03 \leq Nb+Ti+Al+V \leq 0.14$ such that Nb, Ti, Al and V indicate the mass % contents of the respective elements and are 0 when Nb, Ti, Al and V are not added.

6. The abrasion resistant steel plate according to claim 1, wherein the steel plate further comprises at least one of Nd: not more than 1%, by mass %, Cu: not more than 1%, by mass %, Ni: not more than 1%, by mass %, W: not more than 1%, by mass %, Ca: not more than 0.005%, by mass %, Mg: not more than 0.005%, by mass %, and rare earth metal: not more than 0.02%, by mass %.

7. The abrasion resistant steel plate according to claim 6, wherein the contents of Nb, Ti, Al and V satisfy $0.03 \leq Nb+Ti+Al+V \leq 0.14$ such that Nb, Ti, Al and V indicate the mass % contents of the respective elements and are 0 when Nb, Ti, Al and V are not added.

8. The abrasion resistant steel plate according to claim 1, wherein the contents of Nb, Ti, Al and V satisfy $0.03 \leq Nb+Ti+Al+V \leq 0.14$ such that Nb, Ti, Al and V indicate the mass % contents of the respective elements and are 0 when Nb, Ti, Al and V are not added.

9. The abrasion resistant steel plate according to claim 1, wherein the plate thickness is 6 to 125 mm.

10. The abrasion resistant steel plate according to claim 1, wherein the Charpy absorbed energy at −40° C. is not less than 27 J.

11. A method for manufacturing an abrasion resistant steel plate, the method comprising:

casting a steel slab;

hot rolling the steel slab into a steel plate having a prescribed plate thickness; and reheating the steel plate to a temperature of $Ac_3$ transformation point or above and subsequently quenching the steel plate by water cooling at a temperature of not less than $Ar_3$ transformation point to a temperature of not more than 250° C., wherein the steel slab has a chemical composition comprising:

C: 0.10 to less than 0.20%, by mass %;

Si: 0.05 to 0.5%, by mass %;

Mn: 0.5 to 1.5%, by mass %;

Cr: 0.05 to 1.20%, by mass %;

Nb: 0.01 to 0.08%, by mass %;

B: 0.0005 to 0.003%, by mass %;

Al: 0.01 to 0.08%, by mass %;

N: 0.0005 to 0.008%, by mass %;

P: not more than 0.05%, by mass %;

S: not more than 0.005%, by mass %;

O: not more than 0.008%, by mass %; and remaining Fe and unavoidable inevitable impurities as a balance.

12. The method for manufacturing an abrasion resistant steel plate according to claim 11, further comprising cooling the hot rolled steel plate by water cooling to a temperature of not more than 250° C.

13. The method for manufacturing an abrasion resistant steel plate according to claim 11, wherein the reheating of the hot rolled steel plate is performed at a rate of not less than 1° C./s.

14. The method for manufacturing an abrasion resistant steel plate according to claim 11, further comprising reheating the cast steel slab to a temperature of 1100° C. or above.

15. The method for manufacturing an abrasion resistant steel plate according to claim 11, wherein the chemical composition further comprises at least one of Nd: not more than 1%, by mass %, Cu: not more than 1%, by mass %, Ni: not more than 1%, by mass %, W: not more than 1%, by mass %, Ca: not more than 0.005%, by mass %, Mg: not more than 0.005%, by mass %, and rare earth metal: not more than 0.02%, by mass %.

16. The method for manufacturing an abrasion resistant steel plate according to claim 15, wherein the contents of Nb, Ti, Al and V satisfy $0.03 \leq Nb+Ti+Al+V \leq 0.14$ such that Nb, Ti, Al and V indicate the mass % contents of the respective elements and are 0 when Nb, Ti, Al and V are not added.

17. The method for manufacturing an abrasion resistant steel plate according to claim 11, wherein the chemical composition further comprises at least one of Mo: not more than 0.8%, by mass %, V: not more than 0.2%, by mass %, and Ti: not more than 0.05%, by mass %.

18. The method for manufacturing an abrasion resistant steel plate according to claim 17, wherein the contents of Nb, Ti, Al and V satisfy 0.03≤Nb+Ti+Al+V≤0.14 such that Nb, Ti, Al and V indicate the mass % contents of the respective elements and are 0 when Nb, Ti, Al and V are not added.

19. The method for manufacturing an abrasion resistant steel plate according to claim 17, wherein the chemical composition further comprises at least one of Nd: not more than 1%, by mass %, Cu: not more than 1%, by mass %, Ni: not more than 1%, by mass %, W: not more than 1%, by mass %, Ca: not more than 0.005%, by mass %, Mg: not more than 0.005%, by mass %, and rare earth metal: not more than 0.02%, by mass %.

20. The method for manufacturing an abrasion resistant steel plate according to claim 19, wherein the contents of Nb, Ti, Al and V satisfy 0.03≤Nb+Ti+Al+V≤0.14 such that Nb, Ti, Al and V indicate the mass % contents of the respective elements and are 0 when Nb, Ti, Al and V are not added.

21. The method for manufacturing an abrasion resistant steel plate according to claim 11, wherein during the hot rolling step, rolling reduction in an unrecrystallized region is not less than 30%.

22. The method for manufacturing an abrasion resistant steel plate according to claim 11, wherein the contents of Nb, Ti, Al and V satisfy 0.03≤Nb+Ti+Al+V≤0.14 such that Nb, Ti, Al and V indicate the mass % contents of the respective elements and are 0 when Nb, Ti, Al and V are not added.

* * * * *